US006357271B1

(12) United States Patent
Hsu

(10) Patent No.: US 6,357,271 B1
(45) Date of Patent: Mar. 19, 2002

(54) MULTI-LAYER TYPE LOCK CORE STRUCTURE OF A CYLINDRICAL LOCK

(76) Inventor: Fong-Shiang Hsu, 3rd. Fl.-1, 505 Kuangfu S. Road, Taipei, 106 (TW)

( * ) Notice: Subject to any disclaimer, the term of this patent is extended or adjusted under 35 U.S.C. 154(b) by 0 days.

(21) Appl. No.: 09/395,376

(22) Filed: Sep. 14, 1999

(51) Int. Cl.[7] ..... E05B 27/00

(52) U.S. Cl. ..... 70/491; 70/375; 70/378; 70/419

(58) Field of Search ..... 70/491, 363, 373, 70/378, 419

(56) References Cited

U.S. PATENT DOCUMENTS

| | | | | | |
|---|---|---|---|---|---|
| 3,903,720 | A | * | 9/1975 | Scherbing | 70/491 |
| 4,233,828 | A | * | 11/1980 | Dauenbaugh | 70/491 |
| 4,621,510 | A | * | 11/1986 | Scherbing | 70/491 |
| 4,653,297 | A | * | 3/1987 | Moorhouse | 70/491 |
| 4,802,354 | A | * | 2/1989 | Johnson | 70/491 |
| 4,977,768 | A | * | 12/1990 | Embry | 70/491 |
| 4,996,856 | A | * | 3/1991 | Lin et al. | 70/491 X |
| 5,018,376 | A | * | 5/1991 | Lee | 70/491 |
| 5,400,629 | A | * | 3/1995 | Myers | 70/491 |

FOREIGN PATENT DOCUMENTS

| | | | | |
|---|---|---|---|---|
| GB | 1376011 | * | 12/1974 | 70/491 |
| IT | 333162 | * | 12/1935 | 70/491 |
| SE | 312498 | * | 7/1969 | 70/491 |

* cited by examiner

*Primary Examiner*—Suzanne Dino Barrett
(74) *Attorney, Agent, or Firm*—Pro-Techtor International Services

(57) ABSTRACT

A multi-layer type lock core structure of a cylindrical lock, having multi-layer and multi-pin design which provides numerous possibility of change and enhances the safety of the lock. There are twelve sets of upper pins and ten sets of lower pins. The upper pins and the lower pins are designed with different levels, wherein the upper pins are designed with different lengths and pushed by the springs and the lower pins so that the upper pins always protrude beyond the surface of the pin ring. Multiple layers of upper pins and pin rings can be disposed, whereby when changing the number of the cylindrical lock, there are over twelve sets of possibility of change so that in case the key misses or is duplicated, the safety of the lock can be still ensured. Therefore, the lock can be more widely applied to various fields. In addition, the fixing spile of the lock is free from any locating hole so that an alien tool has no force application point to pry and damage the lock.

2 Claims, 4 Drawing Sheets

MULTI-LAYER TYPE LOCK CORE STRUCTURE OF A CYLINDRICAL LOCK

BACKGROUND OF THE INVENTION

The present invention relates to a multi-layer type lock core structure of a cylindrical lock, having multi-layer and multi-pin design which provides numerous possibility of change and enhances the safety of the lock. Therefore, the lock can be more widely applied to various fields. In case the key misses or is duplicated, the safety of the lock can be still ensured. In addition, the lock core has no force application point so that the lock is prevented from being pried and damaged by an alien tool.

A conventional cylindrical lock has a lock casing in which a lock core, a lock seat and seven sets of number-changing engaging pins are installed. The end of the key is formed with multiple dents with different depths for pressing and pushing the engaging pins and retracting the engaging pins into the dents so as to disengage the lock core from the lock seat and turn and unlock the lock. The above seven pin-type cylindrical lock has small volume and can be conveniently used so that it is widely applied to specific appliances such as vending machine and electric game. However, it often takes place that such lock is damaged by a specific tool. Moreover, such seven pin-type cylindrical lock can be unlocked by single key. Therefore, in case the key misses or is duplicated by unauthorized person, the lock will lose its function and needs to be replaced. This leads to waste of labor and money.

In addition, as shown in FIG. 4, the rims of the key way and the lock core of the conventional cylindrical lock are formed with lock core guide channel 1*a* for guiding a tenon 3*a* of the key during insertion. The guide channel 1*a* often serves as a force application point for an alien tool to insert and pry open the lock.

SUMMARY OF THE INVENTION

It is therefore a primary object of the present invention to provide an improved multi-layer type lock core structure of a cylindrical lock, having multi-layer and multi-pin design. There are twelve sets of upper pins and ten sets of lower pins which provides over twelve sets of possibility of change in changing the number so that in case the key misses or is duplicated, the safety of the lock can be still ensured. The number can be more variously changed to avoid cost for replacement of the lock and repeatedly use of the lock. Therefore, the lock can be more widely applied to various fields.

It is a further object of the present invention to provide the above cylindrical lock in which the conventional key guiding channel formed on the rims of the key way and the lock core are eliminated and the lock way has a complete design. Therefore, there is no force application point for an alien tool such as a conventional cylindrical key or universal key to insert and pry open the lock. Moreover, the internal pin ring fixing spile of the lock has cylindrical shape and polished surface. Therefore, even if a tool is inserted, the tool can hardly press and forcedly rotate the lock core. Even if the tool can turn the fixing spile, the twelve engaging pin design possesses better strength than the connecting pin of the fixing spile so that the connecting pin of the fixing spile will drive the pin ring to idle so that the lock cannot be rotated and unlocked. Therefore, the lock is more resistant against damage and can provide enhanced safety.

The present invention can be best understood through the following description and accompanying drawings wherein:

DETAILED DESCRIPTION OF THE PREFERRED EMBODIMENTS

Figure 1:
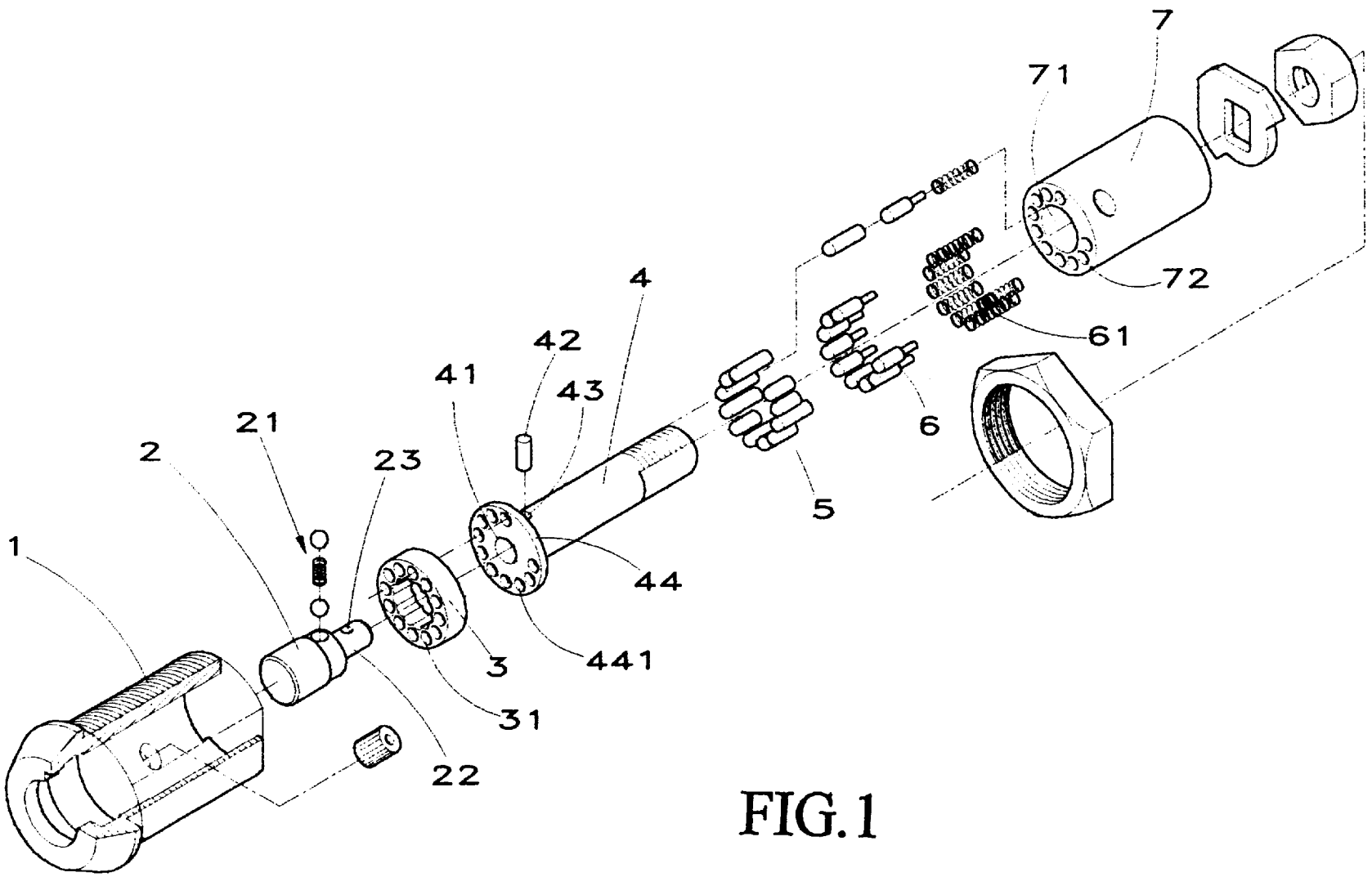
FIG. 1 is a perspective exploded view of the present invention.

Please refer to FIG. 1. The present invention includes a lock casing 1, a pin ring fixing spile 2, a pin ring 3, a lock core 4, twelve sets of upper pins 5, ten sets of lower pins 6 and a lower pin seat 7. The fixing spile 2 is engaged in the pin ring 3 by means of a set of spring steel ball 21. The inner circumference of the pin ring 3 is formed with multiple arch channels for stage by stage engaging with and locating the steel ball 21. The end face of the pin ring 3 is formed with over 12 circular through holes 31 through which the upper pins 5 are passed. The lower end of the fixing spile 2 is disposed with a projecting post 22 for fitting into a central hole 41 of the lock core 4. The projecting post 22 is formed with an insertion hole 23 and the stem of the lock core 4 is formed with an insertion hole 43, whereby a connecting pin 42 is inserted into the insertion holes 43, 23 to associate the fixing spile 2 with the lock core 4. The front end of the lock core 4 is disposed with a disc 44 formed with sequentially arranged 10 through holes 441 corresponding to the through holes 31 of the pin ring 3 for the upper and lower pins 5, 6 to pass therethrough. The lock core 4 is fitted into a central hole 71 of the lower pin seat 7. The end face of the lower pin seat 7 is formed with 10 through holes 72 corresponding to the through holes 441 of the lock core 4 for fitting therein the lower pins 6 and the springs 61 fitted around the lower pins 6. It should be noted that the number and positions of the through holes 72 of the lower pin seat 7 correspond to those of the through holes 441 of the lock core 4. The number of the through holes 31 of the pin ring 3 is more than the aforesaid 10 (such as 12), while the positions of the through holes 31 correspond to those of the through holes 72, 441 for the pin ring 3 to rotate and change the number. Moreover, the upper pins 5 and the lower pins 6 are designed with different levels. The upper pins 5 are designed with different lengths and pushed by the springs 61 and the lower pins 6 so that the upper pins 5 always protrude beyond the surface of the pin ring 3.

Figure 2:
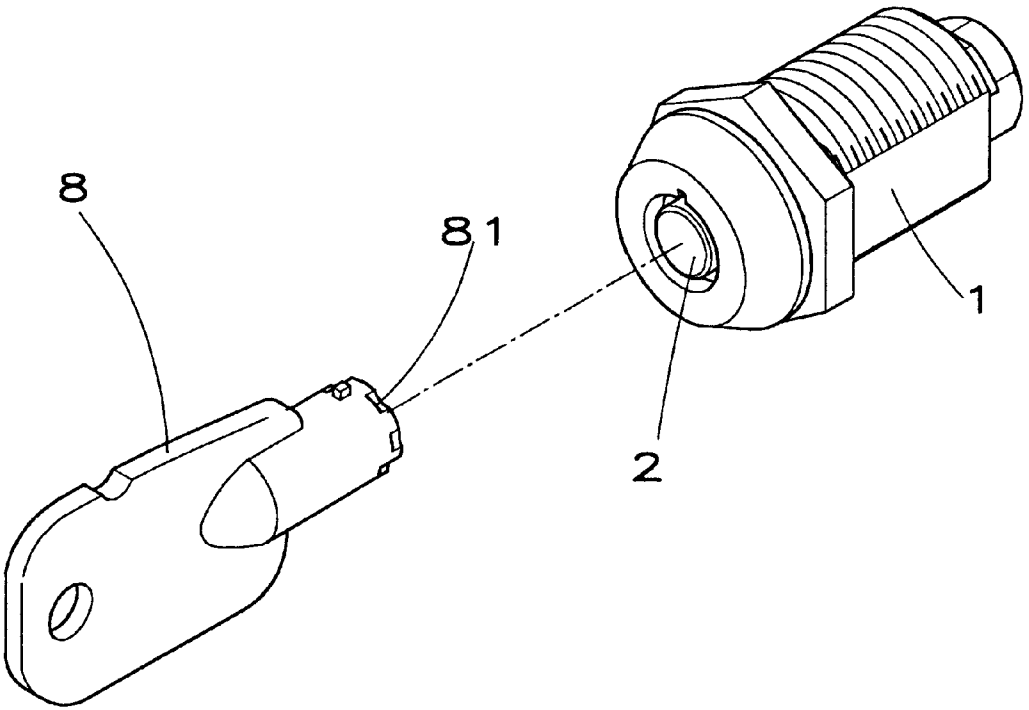
FIG. 2 is a perspective view showing the appearance of the lock body and key of the present invention.

The present invention is operated in such a manner that the rim of the end section of a key 8 (as shown in FIG. 2) is formed with multiple dents 81 with different depths. The key 8 is forced to make the end face thereof tightly abut against the end face of the pin ring 3 and make the upper pins 5 retracted in the respective dents 81 of the key 8. In the case that the key 8 is the right one, the depths of the dents 81 just meet the upper pins 5, whereby the adjoining line of the 12 upper pins 5 and the lower pins 6 is positioned on lower side of the lock core 4 on the same level as the lower pin seat 7. At this time, the key 8 can be used to drive and turn the lock core 4 and unlock the lock. In the case that the key 8 is incorrect, the upper pins 5 will be retracted to different extents so that the 12 upper pins 5 and lower pins 6 cannot form the adjoining line on the same level. Under such circumstance, the lock core 4 cannot be rotated and the lock is still locked. Furthermore, when it is desired to change the number, a previously manufactured controlling key (not shown) is inserted into the key way. The control key is formed with dents corresponding to the upper pins 5 for pushing the same and making the adjoining level of the upper and lower pins 5, 6 just positioned between the pin ring 3 and the disc 44 of the lock core 4. At this time, the pin ring 3 can be rotated relative to the lock core 4 so as to modify the relative positions of the through holes 31, 441 of the pin ring 3 and the disc 44 and change the set position. Accordingly, in case the key misses or is duplicated, the number of the lock can be changed.

Figure 4:
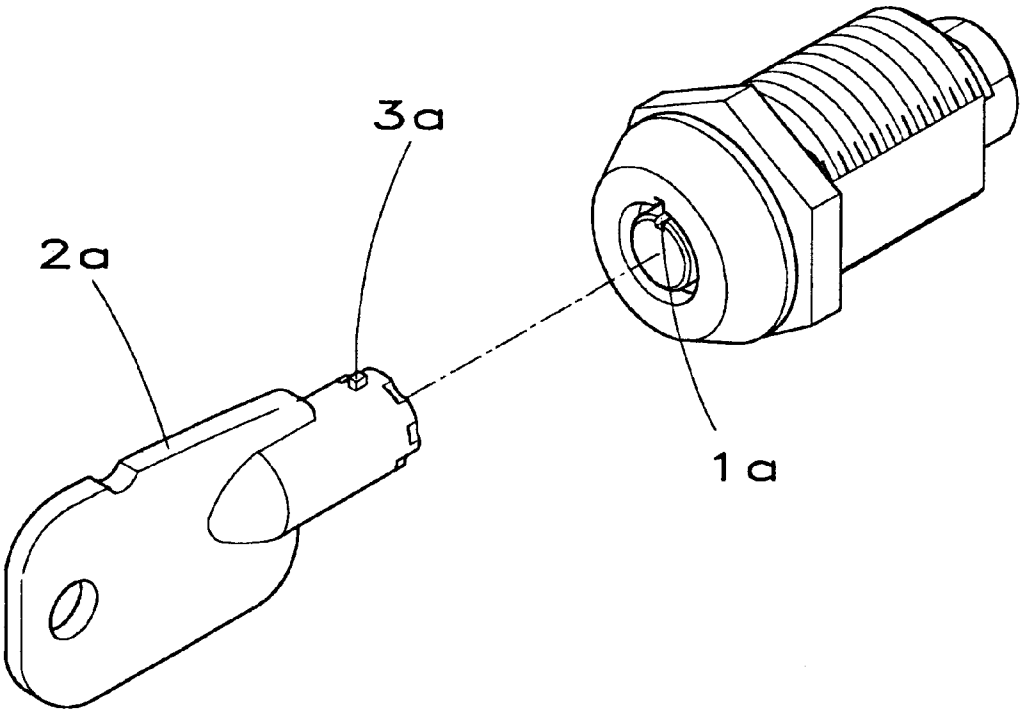
FIG. 4 shows the conventional cylindrical lock and a key thereof.

Further referring to FIG. 4, according to the above arrangement, the control of the present invention is accomplished inside the pin ring 3. Therefore, it is unnecessary to additionally design lock core guide channel 1*a* and tenon 3*a* outside the key way as the conventional lock. Therefore, an alien tool has no force application point to pry and damage the lock.

Figure 3:
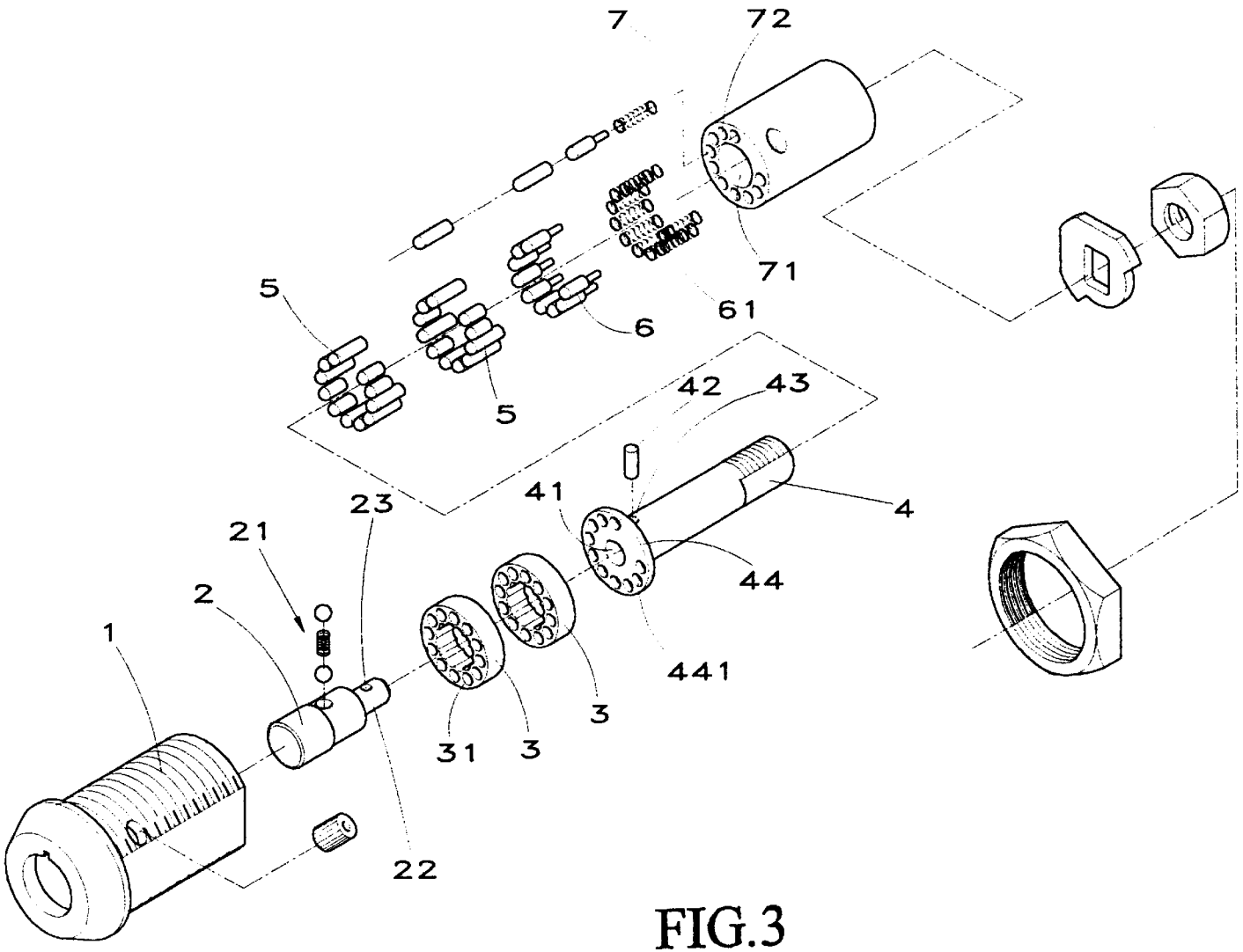
FIG. 3 is a perspective exploded view of another embodiment of the present invention.

Finally, FIG. 3 shows a modification of the present invention which has multi-layer and multi-pin design. In this embodiment, there are 12 sets of double layers of upper pins 5 and two pin rings 3 in cooperation with the increased length of the double layers. By means of the double layer design, the number change possibility of the present invention is increased from 12 to 144. This greatly reduces the possibility of resolution of the present invention and enhance the safety of the lock. Similarly, when three, four or more layers of upper pins 5 and pin rings 3 are added, the change possibility is increased to 1728, 20736, etc. In this case, the possibility of resolution is more reduced. Therefore, the multi-layer and multi-pin design of the present invention can effectively enhance the safety of the lock. Therefore, the lock can be more widely applied to various fields.

The above embodiments are only used to illustrate the present invention, not intended to limit the scope thereof. Many modifications of the above embodiments can be made without departing from the spirit of the present invention.

What is claimed is:

1. A multi-layer type lock core structure of a cylindrical lock comprising:

a lock casing, a pin ring fixing spile, a pin ring, a lock core, a plurality of upper pins, a plurality of lower pins, and a lower pin seat; wherein said fixing spile is engaged in said pin ring by means of a steel ball and spring set, said steel ball and spring set comprising a pair of steel balls separated by a spring, an end face of said pin ring comprises a plurality of circular through holes which receive said upper pins, a projecting post extends from a lower end of said fixing spile and is received in a central hole of said lock core, said projecting post including an insertion hole, a stem of said lock core also includes with an insertion hole, a connecting pin is inserted into said insertion hole of said projecting post and an insertion hole of said stem of said lock core to associate said fixing spile with said lock core, a front end of said lock core comprises a disc with a plurality of through holes corresponding in location to said through holes of said pin ring so that said upper and lower pins pass through said through holes of said disc and said pin ring, said lock core is received in a central hole of said lower pin seat, an end face of said lower pin seat being formed with through holes corresponding in location to said through holes of said disc of said lock core, said through holes of said lower pin seat receiving said lower pins and springs fitted around said lower pins; and wherein said lock core comprises twelve sets of upper pins and ten sets of lower pins, and a number and positions of said through holes of said pin ring and said lower pin seat correspond to said upper and lower pins respectively, a number of said through holes of said pin ring being greater than twelve, and the positions of said through holes of said pin ring corresponding to those of said through holes of said lower pin seat and said lock core, and said upper pins have a plurality of different lengths and are pushed by said springs and said lower pins so that said upper pins protrude beyond a surface of said pin ring.

2. A multi-layer type lock core structure of a cylindrical lock as claimed in claim 1, wherein said structure comprises at least two layers of upper pins and pin rings.

* * * * *